US006016721A

United States Patent [19]

Braun

[11] Patent Number: 6,016,721

[45] Date of Patent: Jan. 25, 2000

[54] DEVICE FOR OPENING BOTTLES WITH NATURAL CORKS, PREFERABLY BOTTLES OF SPARKLING WINE

[76] Inventor: Dieter Braun, Flurstrasse 1 C, 85649 Brunnthall, Germany

[21] Appl. No.: 08/964,275

[22] Filed: Nov. 4, 1997

[30] Foreign Application Priority Data

Nov. 5, 1996 [DE] Germany ..... 196 45 565

[51] Int. Cl.[7] ..... B67B 7/18

[52] U.S. Cl. ..... 81/3.29; 81/3.55

[58] Field of Search ..... 81/3.36, 3.29, 81/3.55

[56] References Cited

U.S. PATENT DOCUMENTS

| | | |
|---|---|---|
| 2,761,338 | 9/1956 | Hardy . |
| 4,527,450 | 7/1985 | Drosky . |
| 4,590,821 | 5/1986 | Olson . |
| 4,598,613 | 7/1986 | Baum . |
| 4,680,993 | 7/1987 | Feliz . |
| 4,708,033 | 11/1987 | Eash . |
| 4,947,711 | 8/1990 | Giebeler . |

FOREIGN PATENT DOCUMENTS

| | | |
|---|---|---|
| 0164955 | 12/1985 | European Pat. Off. . |
| 0229560 | 7/1987 | European Pat. Off. . |
| 0291546 | 11/1988 | European Pat. Off. . |
| 0325011 | 7/1989 | European Pat. Off. . |
| 164199 | 9/1904 | Germany . |
| 2644647 | 4/1978 | Germany . |

OTHER PUBLICATIONS

Copy of a European Search Report completed on Feb. 10, 1998.

*Primary Examiner*—James G. Smith
*Attorney, Agent, or Firm*—Greenblum & Bernstein, P.L.C.

[57] ABSTRACT

Device for opening bottles with natural corks. The device may include a bottle rest to be laterally positioned around a neck of the bottle to encircle a mouth of the bottle on three sides and from above and below the mouth, a holding tongue downwardly extending from the bottle rest adapted to be positioned adjacent the bottle neck, and a cork holder to hold a head of the cork on three sides and from above and below the head of the cork. The cork holder may be movably mounted in the bottle rest, and a lever may be rotatably mounted to the bottle rest, such that rotational movement of the lever provides relative movement between the bottle rest and the cork holder. The cork holder may be pivotably mounted around a rotational axis of the bottle rest at an upper end of a lifting motion, such that the rotational axis runs perpendicular to a longitudinal axis of the bottle and is positioned eccentrically at a level of a bottle opening. The lever may include a stop mechanism to define the upper end of the lifting motion and a curved deaeration track arranged such that, during rotation of the lever, the cork holder rotates around the rotational axis under the pressure of the cork.

22 Claims, 6 Drawing Sheets

DEVICE FOR OPENING BOTTLES WITH NATURAL CORKS, PREFERABLY BOTTLES OF SPARKLING WINE

CROSS-REFERENCE TO RELATED APPLICATION

The present application claims priority under 35 U.S.C. § 119 of German Patent Application No. 196 45 565.0 filed Nov. 5, 1996, the disclosure of which is expressly incorporated by reference herein in its entirety.

BACKGROUND OF THE INVENTION

1. Field of the Invention

The present invention relates to a device for opening bottles with natural corks, and preferably bottles of sparkling wine. The bottle opening device may include a bottle rest to be laterally pushed onto a neck of the bottle to encircle a mouth of the bottle on three sides and from above and below. The device may also include a holding tongue formed from the bottle rest to rest against the neck of the bottle, and a cork holder to hold a head of a cork on three sides and from above and below. The cork holder may be movably mounted in the bottle rest to perform a lifting motion relative to the bottle rest. The device may also include a lever pivotably mountable to the bottle rest to move the cork holder relative to the bottle rest. The cork holder can be pivoted around a rotational axis of the bottle rest at an upper end of a lifting motion. The rotational axis may be positioned to run substantially perpendicular to an axis of the bottle and may be positioned eccentrically at a level of a bottle opening. The lever may include a stop mechanism to stop the cork holder at the upper end of the lifting motion, and the lever may include a curved deaeration track arranged such that when the lever may be moved to rotate the cork holder around the rotational axis of the bottle rest under the pressure of the cork.

2. Discussion of the Background Information

Numerous devices substantially similar to the devices generally described above are known in the prior art.

For example, in U.S. Pat. No. 2,761,338 a device is shown in which a holder is pushed laterally onto the neck of a bottle. U.S. Pat. No. 4,527,450 shows a device which can be pushed laterally onto the head of the cork jutting out of the bottle. In this manner, the cork is pulled out by via of a pulling lever. European Patent Publication 0 164 955 describes device with which a cork is removed from the bottle via a pivoting lever mounted on a part that holds the bottle. Finally, in European Patent Publication 0 291 546 a device is known which is similar in general to the features of the present invention.

In accordance with the prior art devices, a cork may be extracted or removed from a bottle. However, these devices suffer certain disadvantages in that they cannot open a bottle in a controlled fashion. That is, according to the pressure and temperature, the cork is released with a greater or lesser explosion. When the bottle contains, e.g., sparkling wine, the explosion of the cork removal also releases much of the "carbon dioxide" found in the sparkling wine. In this manner, the contents of the bottle generally ends up foaming over adversely affecting the taste of the wine.

SUMMARY OF THE PRESENT INVENTION

The present invention provides a device to open bottles having natural corks so as to reduce the pressure in a controlled fashion. Thus, the present invention provides a cork holder, i.e., a component to hold the cork, that may be pivotably rotated around a rotational axis of a bottle rest, i.e., a component to hold the bottle, at an upper end of a lifting motion. The rotational axis may run substantially perpendicular to the bottle axis and may be eccentrically mounted at a level of a bottle opening. The lever may have a stop mechanism to stop the cork holder at the upper end of the lifting motion, and the lever may include a curved deaeration track positioned to rotate the cork holder around the rotational axis of the bottle rest under the pressure of the cork.

The advantages to the device of the present invention are evident in, e.g., that bottles with natural corks can be opened easily, that an explosion of the cork and thus a sudden release of the "carbon dioxide" contained in the wine may be avoided, and that the device is very simple and comfortable to use.

The present invention is directed to a device for opening bottles with natural corks. The device may include a bottle rest to be laterally positioned around a neck of the bottle to encircle a mouth of the bottle on three sides and from above and below the mouth, a holding tongue downwardly extending from the bottle rest adapted to be positioned adjacent the bottle neck, and a cork holder to hold a head of the cork on three sides and from above and below the head of the cork. The cork holder may be movably mounted in the bottle rest, and a lever may be rotatably mounted to the bottle rest, such that rotational movement of the lever provides relative movement between the bottle rest and the cork holder. The cork holder may be pivotably mounted around a rotational axis of the bottle rest at an upper end of a lifting motion, such that the rotational axis runs perpendicular to a longitudinal axis of the bottle and is positioned eccentrically at a level of a bottle opening. The lever may include a stop mechanism to define the upper end of the lifting motion and a curved deaeration track arranged such that, during rotation of the lever, the cork holder rotates around the rotational axis under the pressure of the cork.

In accordance with another feature of the present invention, the lever may further include a substantially u-shaped yoke having two substantially parallel plate-shaped ends. The substantially parallel plate-shaped ends may include the stop mechanism and the curved deaeration track and further may include a curved lifting track to raise the cork holder with respect to the bottle rest, and a curved guiding track to pivot the cork holder to a final open position. Further, the curved lifting track, the stop mechanism, the curved deaeration track, and the curved guiding track may be arranged to merge together to form a single continuous groove. When the cork is pulled up, a force applied to the lever a substantially vertically downward force, and a deaeration of the bottle and removal of the cork occur by moving the lever in an opposite direction.

In accordance with a further feature of the present invention, the stop mechanism may include a cylindrical peg coupled to the cork holder and the curved deaeration track may include a wavy profile having interior radii approximately corresponding with a radius of the cylindrical peg.

In accordance with still another feature of the present invention, the cork holder may be mounted to the bottle rest with at least two bolts and at least one of the at least two bolts mount the lever to the bottle rest. Further, the at least two bolts may include at least one upper bolt and at least one lower bolt, and the at least one of the at least two bolts mounting the lever to the bottle rest being the at least one upper bolt. Alternatively, the at least two bolts may include two upper bolts and two lower bolts, and the at least one of the at least two bolts mounting the lever to the bottle rest being the two upper bolts.

In accordance with another feature of the present invention, the device may be positionable in a closed position by pivoting the lever into a position substantially parallel to the holding tongue.

In accordance with still another feature of the present invention, the device may also include at least one pulling spring positioned between the bottle rest and the cork holder. The at least one pulling spring may bias the cork holder to abut the bottle rest at a beginning of the lifting motion, may bias the device into an open position after extraction of the cork, and may bias the device into a closed position when closed.

In accordance with a further feature of the present invention, the cork holder may include a curve to facilitate removal of the cork.

In accordance with still another feature of the present invention, the bottle may contain sparkling wine.

The present invention may also be directed to a device for removing a cork from a bottle. The bottle may have a neck and an opening within a mouth portion of the bottle located at an end of the neck. The device may include a bottle rest that is positionable around at least a portion of the mouth portion, and a cork holder that is positionable around at least a portion of the cork. The cork holder may be movably coupled to the bottle rest for rotational and axial movement with respect to the bottle rest. The device may also include a lever coupled to the bottle rest and the cork holder for selectively moving the cork holder one of axially relative to the bottle rest and angularly relative to the bottle rest. The lever may include a stopper mechanism to restrict the axial movement of the cork holder relative to the bottle rest and further include an aerating track for angularly guiding the cork holder relative to the bottle rest.

In accordance with another feature of the present invention, the stopper mechanism and the aerating track may be arranged such that the lever is moved in opposite directions to effect the axial movement and the angular movement of the cork holder relative to the bottle rest.

In accordance with another feature of the present invention, the device may also include a holding tongue extending from bottle rest to stabilize the device during use.

In accordance with a further feature of the present invention, the lever may also include a lifting track arranged to effect axial movement of the cork holder relative to the bottle rest from a position in which the cork holder and the bottle rest are in contact to a point defined by the stop mechanism. Further, the device may include at least one peg coupled to the cork holder and engaging with the lifting track. The lifting track and the deaerating track may be coupled together.

In accordance with a still further feature of the present invention, the device may also include at least one peg coupled to the cork holder and engaging the deaerating track.

In accordance with still another feature of the present invention, the device may include at least one pulling spring for biasing the cork holder and the bottle rest toward each other.

In accordance with another feature of the present invention, the lever may also include a curved track for placing the device in a closed position.

In accordance with a further feature of the present invention, the deaerating track may include a wavy profile for controlling deaeration of the bottle.

In accordance with yet another feature of the present invention, prior to movement along the deaerating track, the bottle may have a greater pressure inside than outside.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the sever views of the drawings, and wherein.

DETAILED DESCRIPTION OF THE INVENTION

Figure 1:
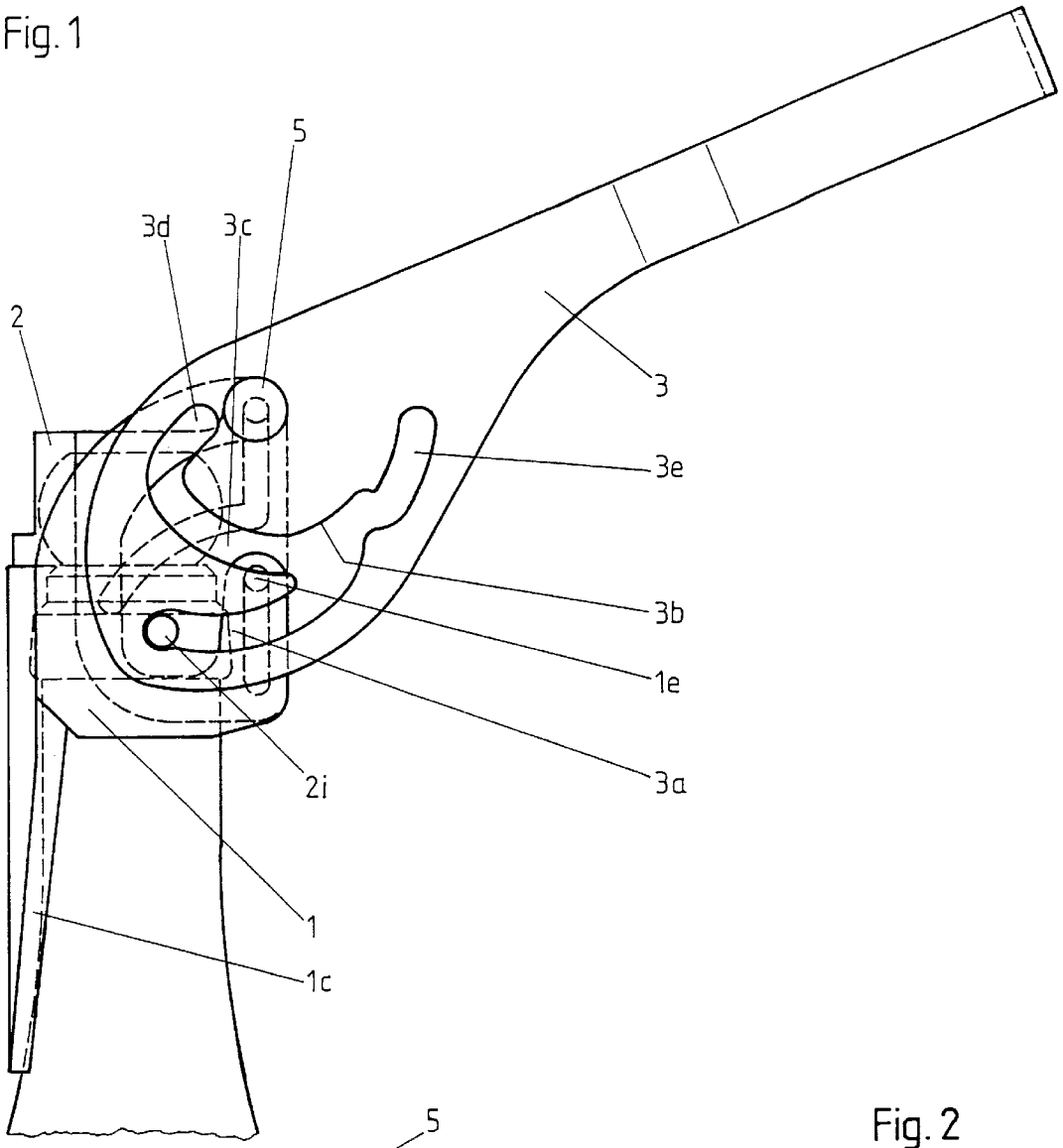
FIG. 1 illustrates a side view of the bottle opening device of the present invention at a beginning of an opening procedure.
Figure 2:
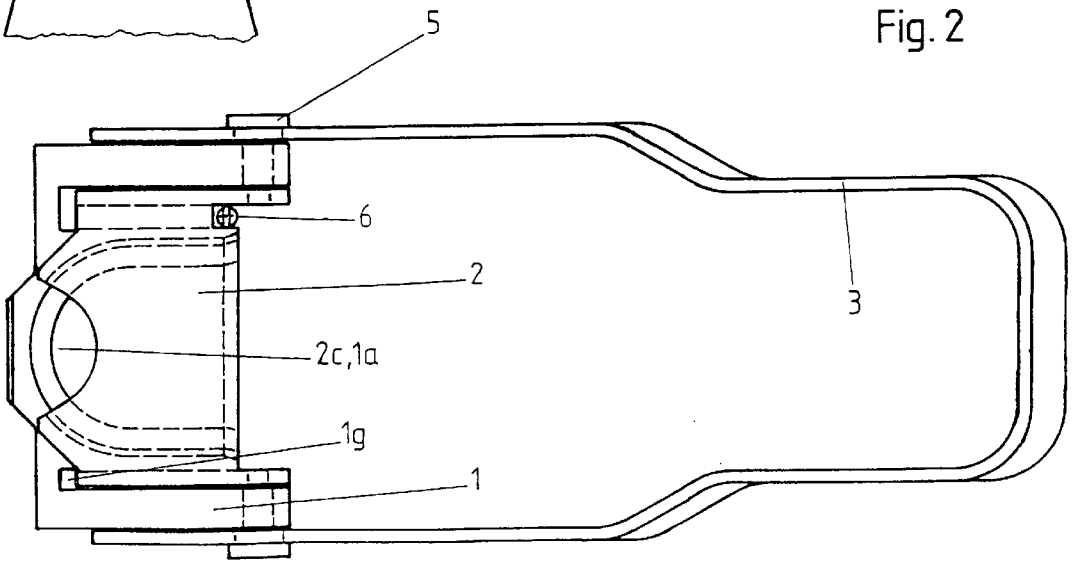
FIG. 2 illustrates a top view of the device of the present invention at the beginning of the opening procedure.

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

As shown in FIGS. 1–6, the bottle opening device in accordance with the present invention includes a bottle rest 1, a cork holder 2, and a lever 3 that may be connected by two bolts 4 and 5. At least one pulling spring 6, which may initially hold the opening device in a starting position, may be suspended between bottle rest 1 and cork holder 2.

Bottle rest 1 may include a c-shaped curve la conformed to fit, e.g., a diameter and cross-section of the bottle. In this manner, bottle rest 1 may be laterally slid or pushed from its open side onto the mouth of a wine bottle. A cross-sectional contour of curve 1*a* may be formed such that mouths of commercially available bottles of champagne and sparkling wine may be held on an upper and lower surface or portion of the bottle mouth. To facilitate placement of bottle rest 1 on the mouth of the bottle, guiding bevels 1*b* may be formed on the open side of curve 1*a*. Guiding bevels 1*b* may also be utilized for retaining the upper and lower portions of the bottle mouth.

On a closed side of c-shaped curve 1*a*, a holding tongue 1*c* may be formed to extend downward from bottle rest 1. Holding tongue 1*c* may be formed to preferably follow a curve of a neck of the bottle and to rest against the curve.

A length of holding tongue 1*c* may be selected such that it may ends in an area in which the neck of the bottle has yet to be sharply curved.

Two substantially vertically parallel holders 1*d* may be positioned on the lateral sides of bottle rest 1, i.e., adjacent the open and closed sides of c-shaped curve 1*a*. Each parallel holder 1*d* may include a lower hinge point 1*e* and an upper hinge point 1*f*.

Between parallel holders 1*d* and an interior portion of c-shaped curve 1*a*, two substantially vertical openings 1*g* may be formed. Further, two vertical tongues 2*a* of cork holder 2 may engage openings 1*g* such that, in a starting position, a lower horizontal surface 2*b* may rest against or abut an upper horizontal surface 1*h* of bottle rest 1 in a vicinity of c-shaped curve 1*a*.

Above resting surface 2*b*, which may rest exactly on an upper edge of the mouth of the bottle being opened and under the head of the cork, cork holder 2 may also have a c-shaped curve 2*c* which may sit axially over curve 1*a* of bottle rest 1. Further, curves 1*a* and 2*a* may be positioned such that their open ends may be directed toward a same side, and their diameters and cross-sections may be formed to enable cork holder 2 to be laterally slid or pushed onto the head of the cork in the bottle. In this regard, cork holder 2 may also include guiding bevels 2*d* located on the open side of curve 2*a* so as to facilitate placement of cork holder 2.

Cork holder 2 may be rigidly mounted in bottle rest 1 via bolts 4 and 5 at hinge points 1*e* and 1*f*. Bolts 4 and 5 may be pointed inward so that they can slide back and forth in sliding guide tracks 2*e*, 2*f*, and 2*g* of vertical tongue 2*a*.

Sliding guide tracks 2*e* and 2*f* may extend substantially vertically and may be of a same length. At a lower end of guide track 2*f*, an arc-shaped guide track 2*g* may be formed to include a center that lies within the lower hinge point of guide 2*e*.

In an upper rear area of c-shaped curve 2*c* of the cork holder, a semi-circular opening 2*h* may be formed to approximately correspond sizewise with a thumb. This facilitates removal of the extracted cork from the cork holder.

Cork holder 2 may be moved across bottle rest 1, e.g., via cylindrical pegs 2*i* which laterally extend outward from cork holder 2 and extend along an axis through and over parallel holders 1*d*. Accordingly, holders 1*d* may be recessed in a vicinity of motion of pegs 2*i*.

Pegs 2*i* may laterally engage with a curved section of a plurality of guiding tracks of lever 3. Lever 3 may be a substantially u-shaped arch and may be rotatably secured at hinge points 1*f*. The plurality of guiding tracks of lever 3 are positioned outwardly adjacent holders 1*d* in a plate-shaped and substantially parallel arrangement.

The plurality of curved guiding tracks arranged in the plates of lever 3 may be axially aligned and may include a curved lifting track 3*a*, a stop mechanism 3*b*, a curved deaeration track 3*c*, a curved guiding track 3*d*, and a curved track 3*e*. Tracks 3*a*–3*e* may be incorporated into a single curved guide track.

Between bottle rest 1 and cork holder 2, and alongside c-shaped curves 1*a* and 2*a*, at least one pulling spring 6 may be suspended to selectively hold the opening device in starting position, in a final open position, or in a closed position. The specific position being selected in accordance with a specific position of the lever.

Figure 8:
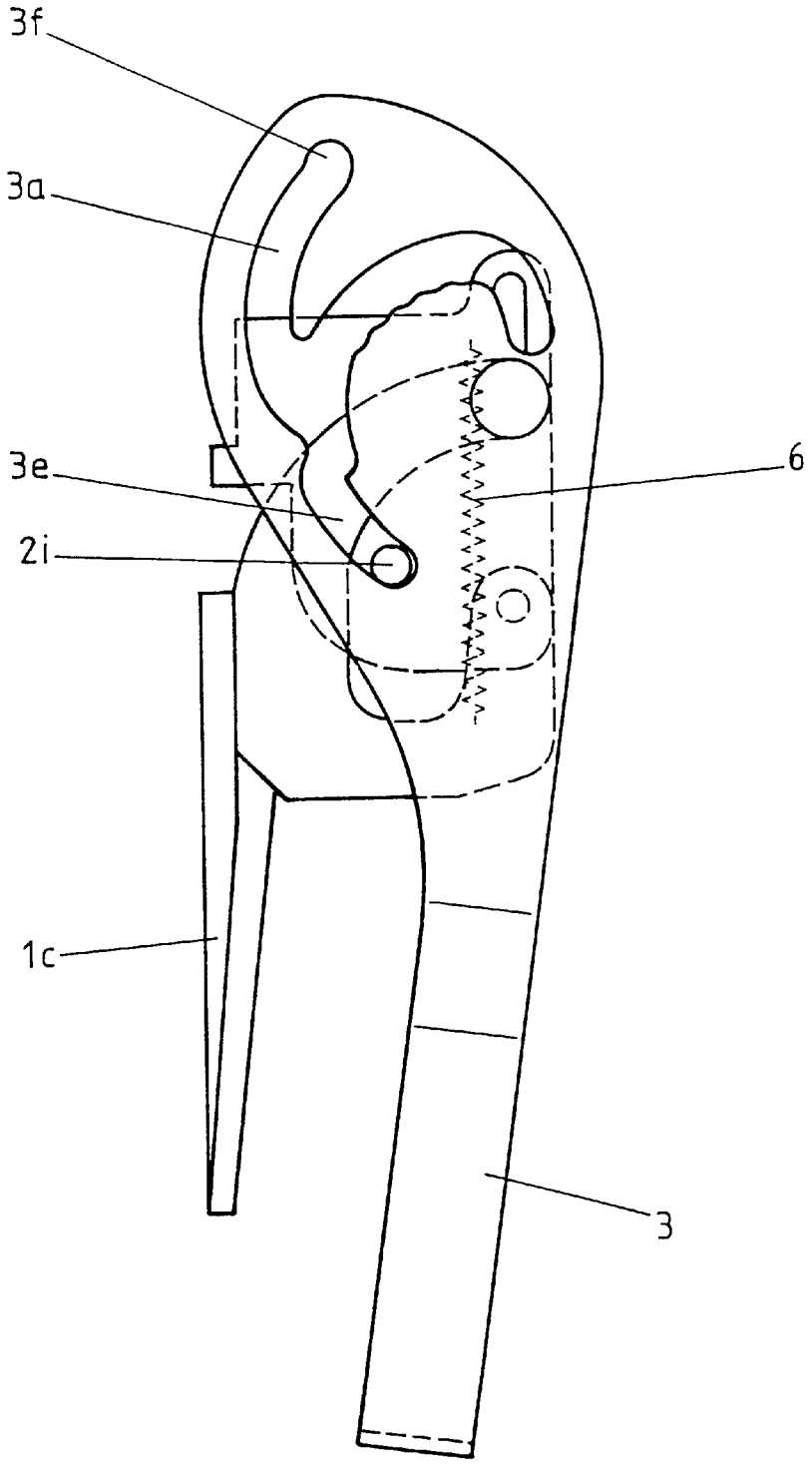
FIG. 8 illustrates a side view of the device of the present invention in a closed position.

In an exemplary manner, the opening device of the present invention may be stored in the closed position, as illustrated in FIG. 8. In the closed position, pegs 2*i* may lie in curved track 3*e* and lever 3 is located in a substantially parallel position to holding tongue 1*c*. In this arrangement, pulling spring 6 holds the opening device in the closed position with a pulling force.

Figure 3:
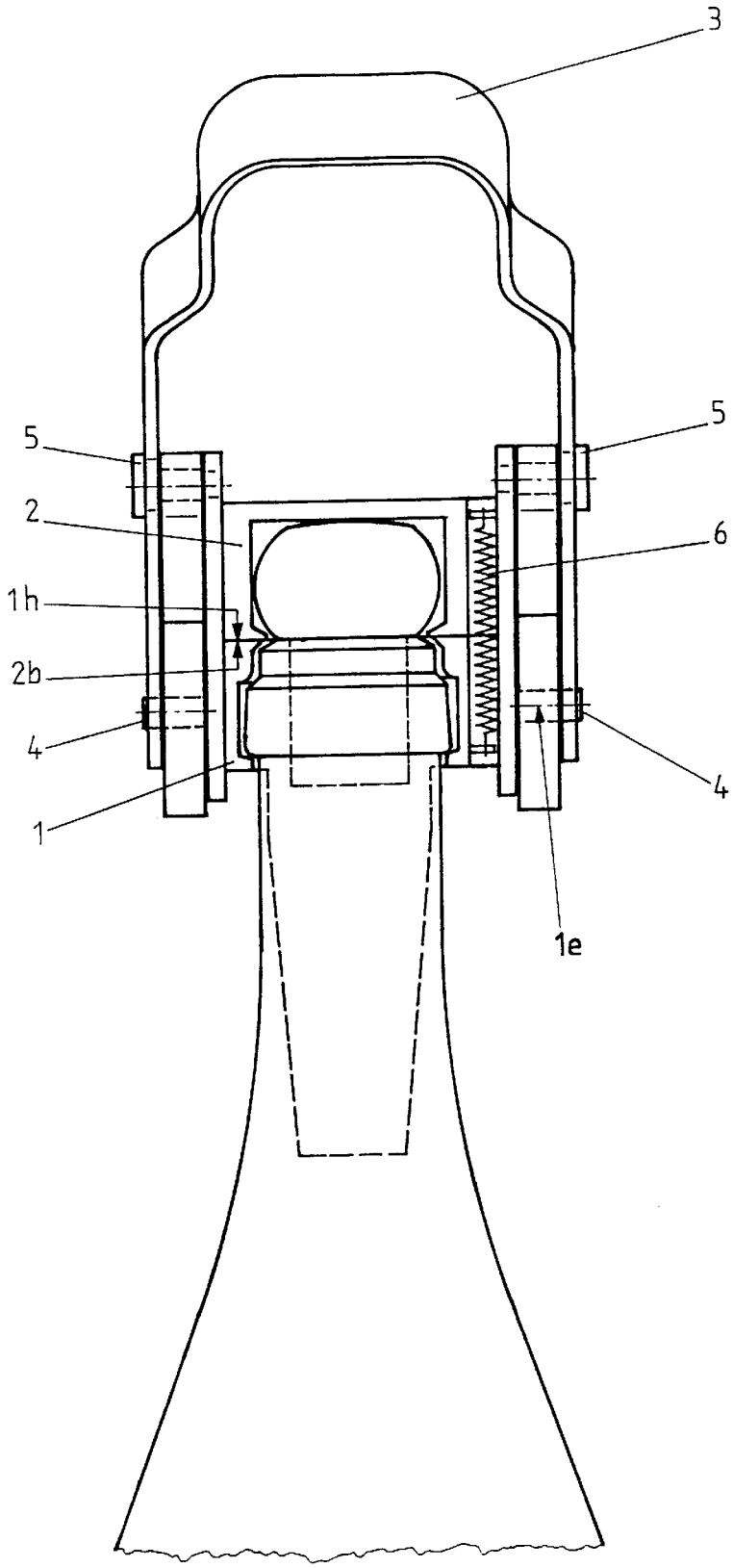
FIG. 3 illustrates a front view of the device of the present invention at the beginning of the opening procedure.
Figure 4:
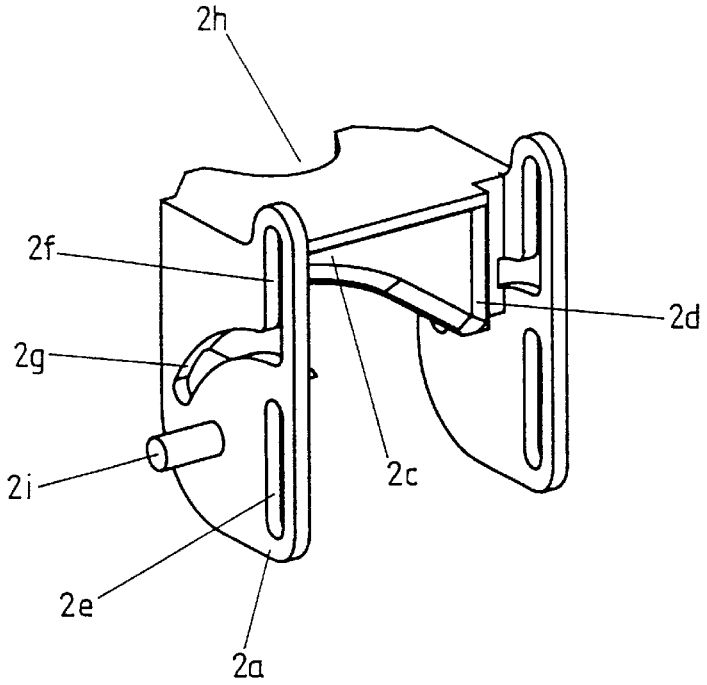
FIG. 4 illustrates a cork holder portion of the present invention.
Figure 5:
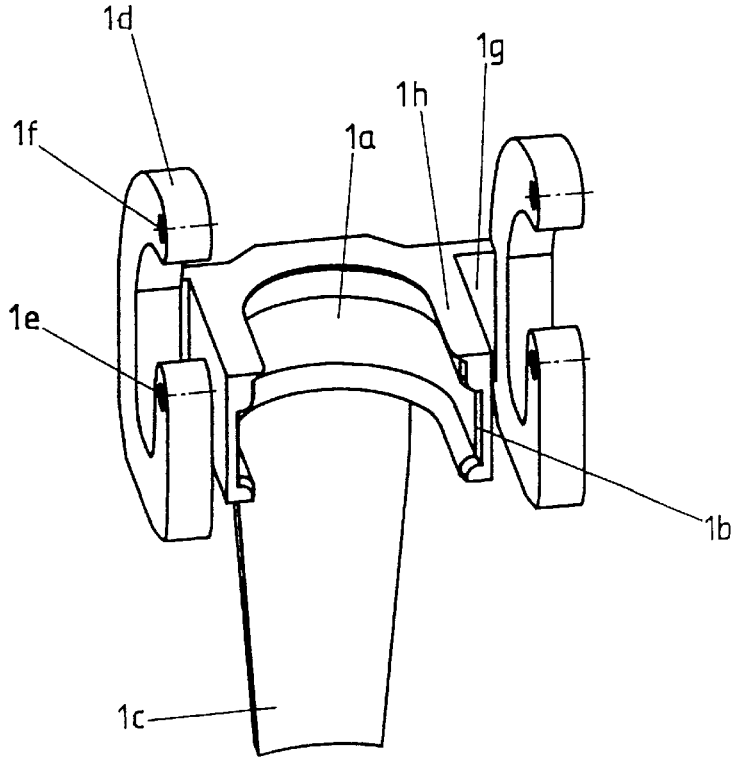
FIG. 5 illustrates a bottle rest portion of the present invention.

To operate the opening device, lever 3 is pulled outwardly, i.e., away from holding tongue 1*c*, so that pegs 2*i* slide along curved track 3*e* and, due to the force of pulling spring 6, slide into curved lifting track 3*a* until reaching the stopping point 3*f*, as shown in FIG. 1. The opening device is now in the starting position, the surfaces 1*h* and 2*b* are positioned adjacent and in contact with each other, as shown in FIG. 3. In this position, the opening device may be laterally pushed onto a bottle with a cork.

When operating the opening device, the user should grip the neck of the bottle with one hand such that holding tongue 1*c* is firmly enclosed. That is, the opening device is inserted around the bottle and cork until holding tongue 1*c* is positioned adjacent the bottle neck.

Figure 6:
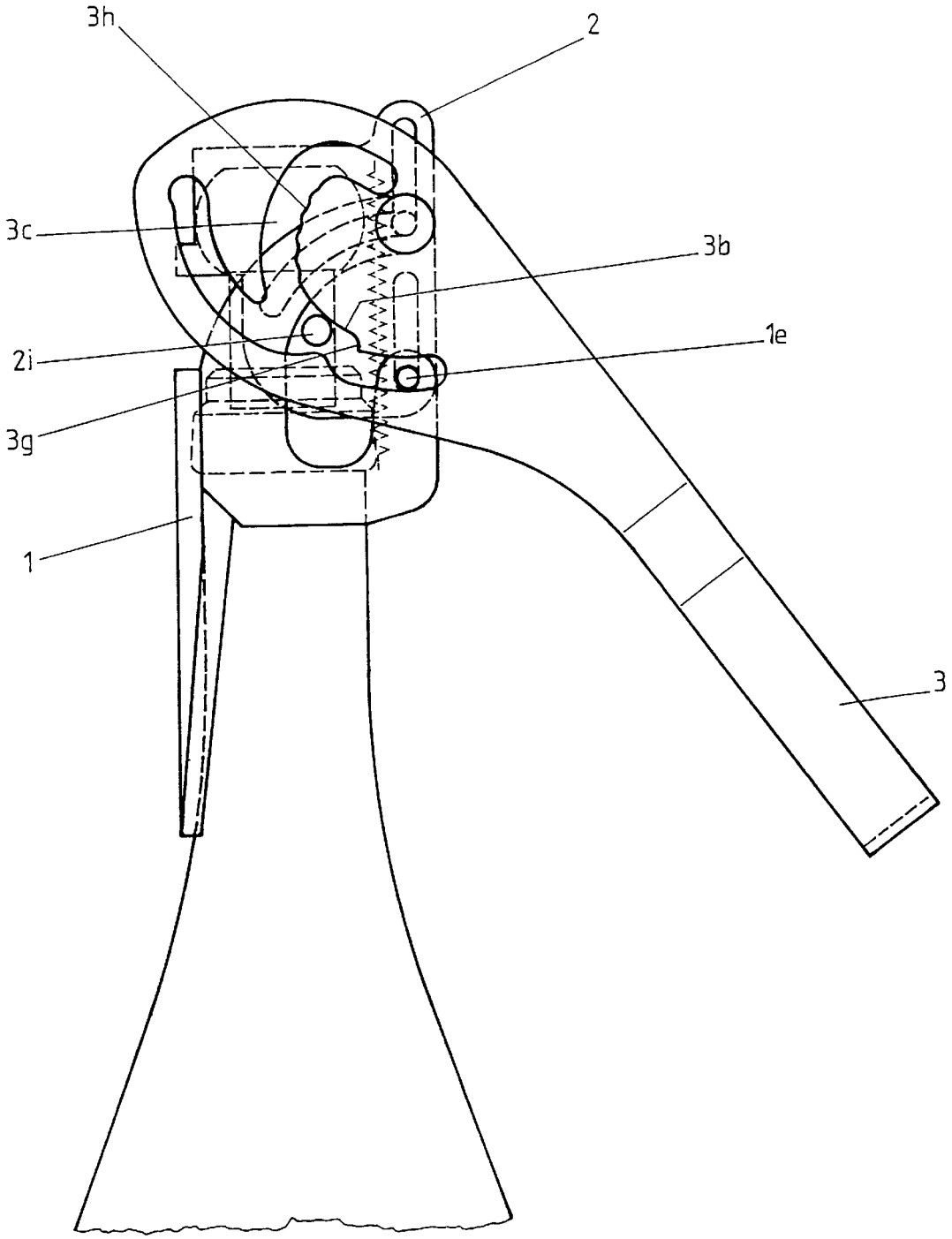
FIG. 6 illustrates a side view of the device of the present invention after completion of a lifting motion of the cork holder.

In the starting position, lever 3 may preferably extend upward at a small angle above the horizontal and the user may easily press lever 3 downward with the other hand. Due to the substantially flat curvature of curved lifting track 3*a*, i.e., with respect to a direction of motion of the cork holder 2, cork holder 2 and the cork may be released from the starting position under light pressure. As the counter pressure of the cork increases, lever 3 may be depressed more and more easily until the force, due to the shape of the cork portion inserted within the bottle neck, is reversed and the cork is pushed out of the bottle by the internal pressure within the bottle. Lever 3 may be continually be moved downward until pegs 2*i* come out of, or exit, curved lifting track 3*a* and come to rest on stop mechanism 3*b* arranged radially to rotation point 1*f*. In this position, as illustrated in FIG. 6, cork holder 2 is in its uppermost position at stop mechanism 3*b*. A safety edge 3*g* prevents lever 3 from being pressed further downward. The position of safety edge 3*g* may be calculated or determined so as to prevent the user's hand from being pinched between lever 3 and the bottle.

Figure 7:
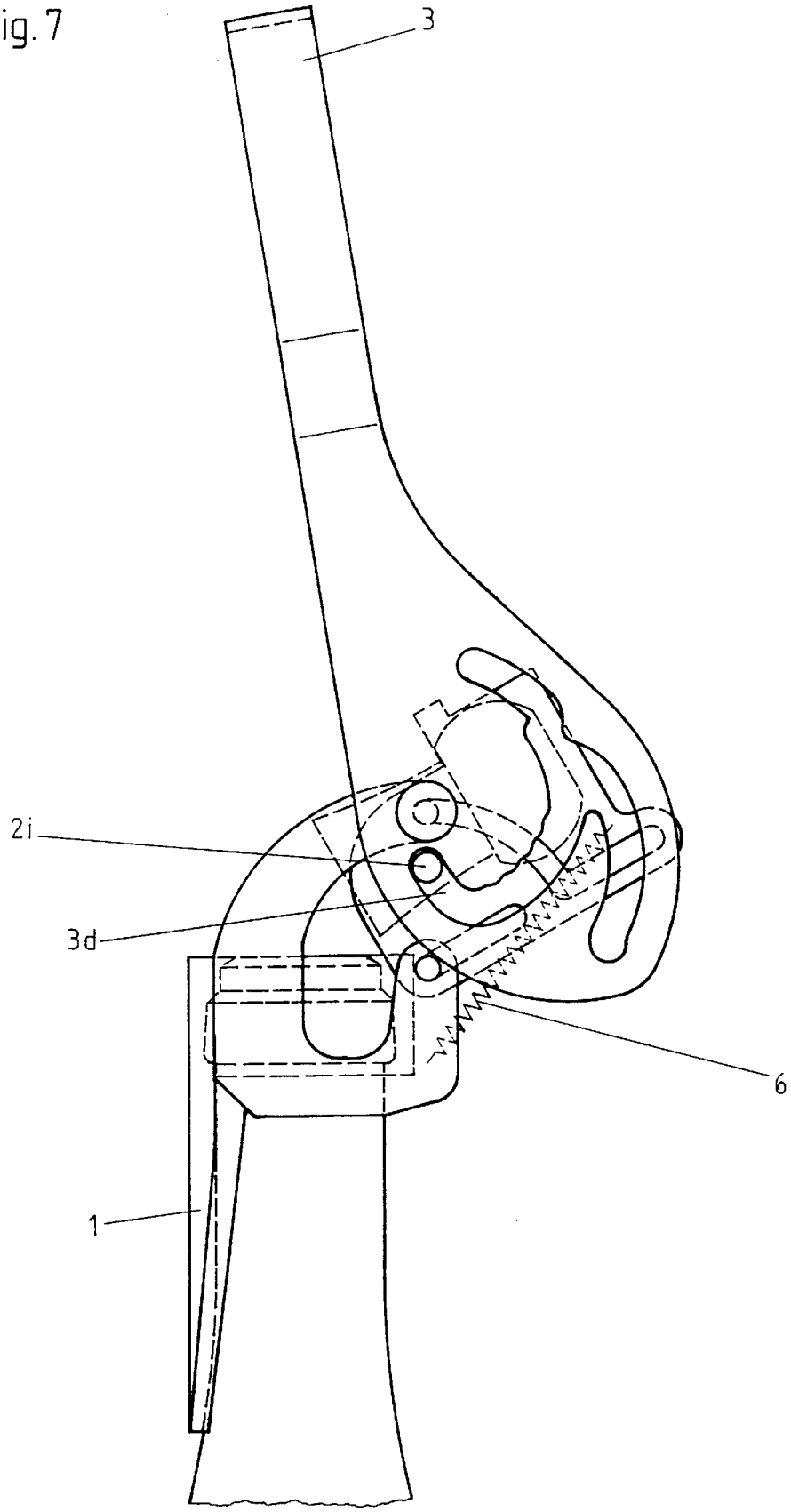
FIG. 7 illustrates a side view of the device of the present invention after completion of the opening procedure.

Finally, to completely uncork the bottle, the bottle should be deaerated. In this embodiment, curved deaeration track 3*c* extends from stop mechanism 3*b* so that deaeration may occur by pressing or moving lever 3 in an opposite direction, i.e., upward and away from the bottle. In this manner, pegs 2*i* may enter curved deaeration track 3*c* due to the upward pressure exerted by the cork. Curved deaeration track 3*c* may be arranged to become radially narrower in a direction of lever rotation point 1*f*. Thus, while lever 3 is being pressed or moved, cork holder 2 may be turned around or rotated about its rotational axis le under the pressure of the cork. The cork may be pushed over the edge of the bottle opening, and may be released on an opposite side thereof, as illustrated in FIG. 7. In this manner, the pressure within the bottle is released.

The more slowly and sensitively the deaeration process is performed, the more the air can be released in a controlled fashion.

To assist in providing a slow and controlled deaeration, curved deaeration track 3*c* may include a wavy profile 3*h* having interior radii approximately corresponding to a radius of pegs 2*i*. Pegs 21 may be moved from crest to crest and the bottle can be slowly deaerated in a steady controlled manner. When the bottle is completely deaerated, the lever is pressed or moved frther until curved guiding track 3*d* pivots cork holder 2, and the retained cork, away from the bottle opening into the final open position shown in FIG. 7. In this final position, pulling spring 6 holds the opening device in this position so that the opening device may be detached from the bottle and so that the cork can be removed from cork holder 2. The device may then be returned to the closed position and stored until its next use.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A device for opening bottles with natural corks comprising:

a bottle rest to be laterally positioned around a neck of the bottle to encircle a mouth of the bottle on three sides and from above and below the mouth;

a holding tongue downwardly extending from the bottle rest adapted to be positioned adjacent the bottle neck;

a cork holder to hold a head of the cork on three sides and from above and below the head of the cork;

the cork holder being movably mounted in the bottle rest;

a lever being rotatably mounted to the bottle rest, such that rotational movement of the lever provides relative movement between the bottle rest and the cork holder;

the cork holder being pivotably mounted around a rotational axis of the bottle rest at an upper end of a lifting motion;

the rotational axis running perpendicular to a longitudinal axis of the bottle and being positioned eccentrically at a level of a bottle opening; and the lever comprising a stop mechanism to define the upper end of the lifting motion of the cork holder and a curved deaeration track arranged such that, during rotation of the lever, the cork holder rotates around the rotational axis under the pressure of the cork.

2. The device in accordance with claim 1, the lever further comprising a substantially u-shaped yoke having two substantially parallel plate-shaped ends;

the substantially parallel plate-shaped ends including the stop mechanism and the curved deaeration track and further including a curved lifting track to raise the cork holder with respect to the bottle rest, and a curved guiding track to pivot the cork holder to a final open position.

3. The device in accordance with claim 2, the curved lifting track, the stop mechanism, the curved deaeration track, and the curved guiding track being arranged to merge together to form a single continuous groove, wherein when the cork is pulled up, a force applied to the lever a substantially vertically downward force, and a deaeration of the bottle and removal of the cork occur by moving the lever in an opposite direction.

4. The device in accordance with claim 1, the stop mechanism comprising a cylindrical peg coupled to the cork holder; and the curved deaeration track comprising a wavy profile having interior radii approximately corresponding with a radius of the cylindrical peg.

5. The device in accordance with claim 1, the cork holder being mounted to the bottle rest with at least two bolts; and at least one of the at least two bolts mounting the lever to the bottle rest.

6. The device in accordance with claim 5, the at least two bolts comprising at least one upper bolt and at least one lower bolt;

the at least one of the at least two bolts mounting the lever to the bottle rest being the at least one upper bolt.

7. The device in accordance with claim 5, the at least two bolts comprising two upper bolts and two lower bolts;

the at least one of the at least two bolts mounting the lever to the bottle rest being the two upper bolts.

8. The device in accordance with claim 1, the device being positionable in a closed position by pivoting the lever into a position substantially parallel to the holding tongue.

9. The device in accordance with claim 1, further comprising at least one pulling spring positioned between the bottle rest and the cork holder;

the at least one pulling spring biasing the cork holder to abut the bottle rest at a beginning of the lifting motion, biasing the device into an open position after extraction of the cork, and biasing the device into a closed position when closed.

10. The device in accordance with claim 1, the cork holder comprising a curve to facilitate removal of the cork.

11. An apparatus, in combination with a bottle having a cork, for removing the cork from the bottle, the combination comprising:

a bottle rest to be laterally positioned around a neck of the bottle to encircle a mouth of the bottle on three sides and from above and below the mouth;

a holding tongue downwardly extending from the bottle rest adapted to be positioned adjacent the bottle neck;

a cork holder to hold a head of the cork on three sides and from above and below the head of the cork;

the cork holder being movably mounted in the bottle rest;

a lever being rotatably mounted to the bottle rest, such that rotational movement of the lever provides relative movement between the bottle rest and the cork holder;

the cork holder being pivotably mounted around a rotational axis of the bottle rest at an upper end of a lifting motion;

the rotational axis running perpendicular to a longitudinal axis of the bottle and being positioned eccentrically at a level of a bottle opening;

the lever comprising a stop mechanism to define the upper end of the lifting motion of the cork holder and a curved deaeration track arranged such that, during rotation of the lever, the cork holder rotates around the rotational axis under the pressure of the cork; and the bottle containing sparkling wine.

12. A device for removing a cork from a bottle, the bottle having a neck and an opening within a mouth portion of the bottle located at an end of the neck, the device comprising:

a bottle rest that is positionable around at least a portion of the mouth portion;

a cork holder that is positionable around at least a portion of the cork;

the cork holder being movably coupled to the bottle rest for rotational and axial movement with respect to the bottle rest;

a lever coupled to the bottle rest and the cork holder for selectively moving the cork holder one of axially relative to the bottle rest and angularly relative to the bottle rest;

the lever comprising a stopper mechanism to restrict the axial movement of the cork holder relative to the bottle rest;

the lever further comprising an aerating track for angularly guiding the cork holder relative to the bottle rest.

13. The device in accordance with claim 12, the stopper mechanism and the aerating track arranged such that the lever is moved in opposite directions to effect the axial movement and the angular movement of the cork holder relative to the bottle rest.

14. The device in accordance with claim 12, further comprising a holding tongue extending from bottle rest to stabilize the device during use.

15. The device in accordance with claim 12, the lever further comprising a lifting track arranged to effect axial movement of the cork holder relative to the bottle rest from a position in which the cork holder and the bottle rest are in contact to a point defined by the stop mechanism.

16. The device in accordance with claim 15, further comprising at least one peg coupled to the cork holder and engaging with the lifting track.

17. The device in accordance with claim 16, the lifting track and the deaerating track being coupled together.

18. The device in accordance with claim 12, further comprising at least one peg coupled to the cork holder and engaging the deaerating track.

19. The device in accordance with claim 12, further comprising at least one pulling spring for biasing the cork holder and the bottle rest toward each other.

20. The device in accordance with claim 12, the lever further comprising a curved track for placing the device in a closed position.

21. The device in accordance with claim 12, the deaerating track comprising a wavy profile for controlling deaeration of the bottle.

22. An apparatus, in combination with a bottle having a cork, for removing the cork from the bottle, the bottle further having a neck and an opening within a mouth portion of the bottle located at an end of the neck, the combination comprising:

a bottle rest that is positionable around at least a portion of the mouth portion;

a cork holder that is positionable around at least a portion of the cork;

the cork holder being movably coupled to the bottle rest for rotational and axial movement with respect to the bottle rest;

a lever coupled to the bottle rest and the cork holder for selectively moving the cork holder one of axially relative to the bottle rest and angularly relative to the bottle rest;

the lever comprising a stopper mechanism to restrict the axial movement of the cork holder relative to the bottle rest;

the lever further comprising an aerating track for angularly guiding the cork holder relative to the bottle rest, and wherein prior to movement along the deaerating track, a pressure inside of the bottle is greater than a pressure outside of the bottle.

* * * * *